US008720792B2

(12) United States Patent
Kobayashi et al.

(10) Patent No.: US 8,720,792 B2
(45) **Date of Patent: *May 13, 2014**

(54) BALLAST RETAINING STRUCTURE, TOOL JIG, AND BEDDED TRACK

(75) Inventors: Mikihito Kobayashi, Nagoya (JP); Masaki Seki, Nagoya (JP); Yasuhito Watanabe, Nagoya (JP); Hironari Muramatsu, Nagoya (JP); Junichi Koseki, Nagoya (JP)

(73) Assignee: Central Japan Railway Company (JP)

( * ) Notice: Subject to any disclaimer, the term of this patent is extended or adjusted under 35 U.S.C. 154(b) by 328 days.

This patent is subject to a terminal disclaimer.

(21) Appl. No.: 13/057,413

(22) PCT Filed: Jul. 31, 2009

(86) PCT No.: PCT/JP2009/063686

§ 371 (c)(1),
(2), (4) Date: Mar. 8, 2011

(87) PCT Pub. No.: WO2010/016442

PCT Pub. Date: Feb. 11, 2010

(65) Prior Publication Data

US 2011/0155818 A1 Jun. 30, 2011

(30) Foreign Application Priority Data

Aug. 5, 2008 (JP) ..... 2008-202249

(51) Int. Cl.
*E01B 1/00* (2006.01)

(52) U.S. Cl.
USPC ..... 238/2

(58) Field of Classification Search
USPC ..... 238/2, 6, 11; 104/2; 404/96; 405/16, 405/262, 284
See application file for complete search history.

(56) References Cited

U.S. PATENT DOCUMENTS

| | | | | |
|---|---|---|---|---|
| 3,841,554 | A * | 10/1974 | Bennett | 238/2 |
| 6,672,515 | B2 * | 1/2004 | Rajaram | 238/2 |
| 8,240,580 | B2 * | 8/2012 | Seki et al. | 238/2 |
| 2007/0245887 | A1 * | 10/2007 | James | 89/36.01 |
| 2010/0193596 | A1 | 8/2010 | Seki et al. | |

FOREIGN PATENT DOCUMENTS

| | | | |
|---|---|---|---|
| DE | 4104683 A1 * | 8/1992 | C04B 26/02 |
| JP | 63-75208 | 4/1988 | |
| JP | 3-180617 | 8/1991 | |
| JP | 8-27701 | 1/1996 | |

(Continued)

OTHER PUBLICATIONS

International Search Report from corresponding PCT Application No. PCT/JP2009/063686 dated Sep. 29, 2009.

(Continued)

*Primary Examiner* — Zachary Kuhfuss
(74) *Attorney, Agent, or Firm* — Grossman Tucker Perreault & Pfleger PLLC

(57) ABSTRACT

A ballast retaining structure according to the present invention is a ballast retaining structure in which ballast laid on the roadbed is tamped to thereby retain a track bed extended in an extending direction of the roadbed from a transverse direction thereof, and includes a layered body formed by a plurality of bag-like objects, each being formed in a bag shape and containing the ballast, which are stacked from a toe of slope to a top of slope of the track bed such that each of the bag-like objects is tilted to decline from an outer end portion to an inner end portion thereof.

11 Claims, 8 Drawing Sheets

(56) References Cited

FOREIGN PATENT DOCUMENTS

| | | |
|---|---|---|
| JP | 8-74201 | 3/1996 |
| JP | 8-144206 | 6/1996 |
| JP | 8-151601 | 6/1996 |
| JP | 9-111704 | 4/1997 |
| JP | 9-137422 | 5/1997 |
| JP | 3040337 | 8/1997 |
| JP | 11-158801 | 6/1999 |
| JP | 11-188661 | 7/1999 |
| JP | 2000-86890 | 3/2000 |
| JP | 2001-271301 | 10/2001 |
| JP | 2002-81001 | 3/2002 |
| JP | 2004-3245 | 1/2004 |
| JP | 2007-182689 | 7/2007 |
| JP | 2008-274627 | 11/2008 |
| WO | 2008/136313 | 11/2008 |

OTHER PUBLICATIONS

English translation of International Preliminary Report on Patentability from corresponding PCT Application No. PCT/JP2009/063686 dated Mar. 17, 2011.

Shinji Yamazaki et al., "Dono o Mochiita Tameike Teitai no Jitsubutsudai Jikken", Proceedings of the Japan National Conference on Geotechnical Engineering, vol. 41, Separate vol. 2, 2, Jun. 20, 2006, pp. 1825 to 1826.

Ken'ichi Matsushima et al., "Dono o Mochiita Tameike Teitai no Shindo Jikken", Proceedings of the Japan National Conference on Geotechnical Engineering, vol. 41, separate vol. 2, 1, Jun. 20, 2006, pp. 685-686.

Notice for Reason(s) for Rejection dated Jul. 3, 2012 issued in corresponding Japanese Patent Application No. 2008-202249, 7 pages.

Chinese Office Action dated Jan. 31, 2012 issued in corresponding Chinese Patent Application No. CN200980131017.8, 13 pages.

* cited by examiner 37a
37b 37c
37b
37a 37c
37b
37a 37a
37b
37c 37b
37c
37a 37
37a
37b

BALLAST RETAINING STRUCTURE, TOOL JIG, AND BEDDED TRACK

TECHNICAL FIELD

The present invention relates to a bedded track in which a track bed is provided on a roadbed, and sleepers and rails are disposed on the track bed, to a ballast retaining structure provided on both sides of the track bed of the bedded track, and to a tool jig used to provide the ballast retaining structure.

BACKGROUND ART

There is a conventionally known bedded track in which a track bed is provided on a roadbed, and sleepers and rails are disposed on the track bed. Such a bedded track typically has a structure such that sleepers are disposed on the track bed formed on the roadbed, and a pair of rails are fastened to the sleepers so as to be spaced at a certain distance and parallel to each other. The track bed constituting the bedded track is made of ballast, slab, and the like, which is selected considering various conditions of each railway. A ballast bed track 1000 using ballast 2, such as gravel, crushed stones, or the like, as exemplarily shown in FIG. 8A and FIG. 8B, has been most known among them. A track bed 1003 using the ballast 2 has been employed for many years since the track bed 1003 supports running of heavy railway cars in a rational manner and is also economically competitive due to the nature thereof. The ballast 2, such as gravel, crushed stones, or the like, has functions to firmly support sleepers 4, to evenly distribute a load transmitted from a train through rails 5 and the sleepers 4 over the roadbed, and to give elasticity to a track as well as to facilitate maintenance work, such as tamping, and to give good drainage of the track thereby to prevent mud-pumping or weed incidence.

However, in the track bed using the ballast as described above, individual gravel particles or crushed stones tend to move in a vicinity of a surface of the track bed. The track bed is easily deformed due to passing train loads, a bulging force resulting from a rail axial force at a high temperature, stress by an earthquake or the like, or subsidence of an embankment structure, and thereby a linear irregularity of the track is sometimes caused. Accordingly, when such a linear irregularity of the track is caused, correction is made by refilling the ballast or tamping the track bed. Such an operation to correct the linear irregularity of the track requires considerable work and cost.

There is also a known track bed using ballast (see, for example, Patent Document 1) in which rigid plates are provided between a plurality of sleepers on the ballast and the rigid plates are mutually connected by U-shaped anchors passing through under the sleepers. However, in an area from a toe of slope to a top of slope of the track bed, individual gravel particles or crushed stones tend to move in a vicinity of a surface of the track bed as described above, and the track bed is easily deformed due to passing train loads, a bulging force resulting from a rail axial force at a high temperature, stress by an earthquake or the like, or subsidence of an embankment structure, and thereby a linear irregularity of the track is sometimes caused.

Therefore, as illustrated by an example in FIG. 8C and FIG. 8D, there has been devised a method (see, for example, Patent Document 2) in which ballast retaining structures 1010 are provided on both sides of a track bed 1103 on a roadbed 1 so that the ballast retaining structures 1010 can suppress deformation of the ballast 2. The ballast retaining structures 1010 which are made of concrete, such as prestressed concrete, are formed in a wall shape.

However, the above-described ballast retaining structure 1010 which is formed in a wall shape with, for example, a width of 50 cm weighs approximately 200 kg per unit. This leads to problems in construction work as follows: (1) It is required to transport the ballast retaining structures by a maintenance car or the like from a storage area to a construction cite at the time of construction. (2) It is required to use heavy equipment for construction. (3) In a case where the ballast retaining structure 1010 has a projection 1010*a*, it is required to bury the projection 1010*a* in the roadbed 1 and thus it is required to widely dig the track bed in a cross-sectional direction perpendicular to rails and backfill the track bed after disposing the ballast retaining structure 1010. Also, it is known that a construction method using the ballast retaining structure 1010 generally results in higher costs.

Then, there has been devised a method in which flexible cloth or polyethylene sandbags filled with a filling material, such as gravel or crushed stones, are disposed on a roadbed, surfaces of the sandbags are covered with crushed stones or the like to form a flat plane, sleepers are disposed on the flat plane, and rails are fastened to the sleepers (see, for example, Patent Documents 3-6). According to the method using sandbags filled with a filling material, advantages can be achieved that subsidence of the rails due to repeated loads by passing railway cars is reduced, and thereby maintenance work for the rails and the track bed is reduced, and that vibration and noise during the passing of the railway cars may be reduced, compared with the conventional method of simply laying gravel or crushed stones.

Patent Document 1: Japanese Unexamined Patent Application Publication No. 9-111704

Patent Document 2: Japanese Unexamined Patent Application Publication No. 8-144206

Patent Document 3: Japanese Unexamined Patent Application Publication No. 8-151601

Patent Document 4: Japanese Unexamined Patent Application Publication No. 8-74201

Patent Document 5: Japanese Unexamined Patent Application Publication No. 2000-86890

Patent Document 6: Japanese Unexamined Patent Application Publication No. 2001-271301

Patent Document 7: Japanese Unexamined Patent Application Publication No. 8-27701

Patent Document 8: Japanese Unexamined Patent Application Publication No. 9-137422

Patent Document 9: Japanese Unexamined Patent Application Publication No. 2007-118847

DISCLOSURE OF THE INVENTION

Problems to be Solved by the Invention

However, the above-described method using sandbags filled with a filling material involves a problem that, while stress increase may be expected due to dilatancy of the sandbags, the material of the sandbags between ballast particles impedes engagement between the ballast particles at a boundary between the sandbags and thereby a sufficient friction cannot be obtained, and resulting slip between the sandbags may lead to deformation of the track bed.

Another method may be devised in which a honeycomb reinforcing material is disposed on a roadbed, and ballast is filled into spaces in the reinforcing material from above to form a track bed (see, for example, Patent Document 7).

However, the method involves a problem that the ballast located above the honeycomb reinforcing material may collapse, leading to deformation of a surface area of the track bed in a transverse or other direction.

A further method may be devised in which a band-like body is attached to each of upper and lower surfaces of each of sandbags, and the sandbags are connected by being bound by a linear member, such as a rope, inserted through band-like bodies (see, for example, Patent Document 8). However, the problem remains unsolved that the material of the sandbags between ballast particles impedes engagement between the ballast particles at a boundary between the sandbags and thereby a sufficient friction cannot be obtained, and the problem remains that resulting slip between the sandbags may lead to deformation of the track bed. There is another problem that, when the sandbags are stacked up, the band-like bodies located between the sandbags impede close contact between the sandbags, and resulting slip between the sandbags may lead to deformation of the track bed.

Another method may be devised in which a chemical agent, such as resin, having a high adherence is sprayed on surfaces of ballast particles or between ballast particles in a track bed, to thereby secure the ballast and thus suppress displacement thereof. However, since the above-described chemical agent, such as resin, is subject to outflow due to rain and degradation due to change over time, the above effect by the chemical agent is not permanent. Accordingly, the chemical agent needs to be sprayed repeatedly at short intervals, and such spraying requires considerable labor and time.

Also, the above-described method using sandbags filled with a filling material involves a possibility that stacked sandbags may slide or fall down due to a horizontal force in such a case where a large inertial force is exerted on the track bed by an earthquake motion in, for example, an area of the track bed with a wide shoulder width.

Moreover, although a plurality of bag-like objects, each being formed in a bag shape and containing ballast, may be stacked in a horizontal state from a toe of slope to a top of slope of the track bed (see, for example, Patent Document 9), there is a possibility that stacked sandbags may slide or fall down due to a horizontal force in such a case where a large inertial force is exerted on the track bed by an earthquake motion, as described above.

The present invention, which has been made in view of these problems, has an object to provide a technique which can suppress deformation of a track bed of a bedded track even in such a case where a large inertial force is exerted on the track bed by an earthquake motion.

Means for Solving the Problems

A ballast retaining structure in a first aspect of the present invention, which has been made to solve the above problems, is used for a bedded track provided with a track bed formed by laying ballast on a roadbed, performing tamping to form a bed-like structure having a predetermined cross-sectional shape such as a trapezoid, and extending the bed-like structure in an extending direction of the roadbed; a plurality of sleepers disposed on the track bed such that longitudinal directions of the sleepers are perpendicular to an extending direction of the track bed; and one or more pairs of rails fastened to upper surfaces of the plurality of sleepers in the extending direction of the track bed. The ballast retaining structure is provided on both sides in a transverse direction of the track bed and in the extending direction of the track bed to thereby retain the track bed from the transverse direction thereof. The ballast retaining structure includes: a layered body extended in the extending direction of the roadbed and formed by stacking a plurality of bag-like objects, each being formed in a bag shape and containing the ballast, from a toe of slope to a top of slope of the track bed such that each of the bag-like objects is tilted to decline from an outer end portion to an inner end portion thereof.

According to the ballast retaining structure of the present invention configured as above, a layered body extended in the extending direction of the roadbed is provided and the layered body is formed by stacking a plurality of bag-like objects, each being formed in a bag shape and containing the ballast, from a toe of slope to a top of slope of the track bed such that each of the bag-like objects is tilted to decline from an outer end portion to an inner end portion thereof. Therefore, it is possible to prevent the layered body from sliding or falling when an outward (or external) horizontal force is exerted, and thus is possible to suppress deformation of the track bed of the bedded track even when a large inertial force due to an earthquake motion is exerted on the track bed.

That is, according to the ballast retaining structure in the first aspect, resistance (horizontal drag force) possessed by a conventional bedded track against horizontal displacement of the track due to engagement effect of the ballast may be further effectively increased, and deformation of a railway track which is maintained in an accurate manner at a millimeter level may be suppressed. Thus, an effect of improving safety of train running may be achieved.

Alternatively, the layered body may be formed by stacking a plurality of bag-like objects, while shifting each of the plurality of bag-like objects toward an inside of the track bed. According to such a configuration, a force of the layered body tilting toward the inside of the track bed becomes great, and thus resistance against a horizontal force is further increased.

Also, the layered body may be formed by stacking a plurality of bag-like objects, while shifting each of the plurality of bag-like objects in an extending direction of the roadbed. According to such a configuration, gaps which are present between rows of the bag-like objects are filled, which increases an entire rigidity, and the bag-like objects adjacent with each other in the extending direction of the bedded track are mutually engaged firmly to be integrated. Thus, resistance against a horizontal force is further increased.

A plurality of communication holes in the bag-like object may be sized not to allow the ballast to pass therethrough. In one example, the communication holes may have diameter dimensions of approximately ½-¼ of an average particle diameter of the ballast.

According to the ballast retaining structure configured as above, ballast particles contained in the bag-like object are not separated one another, and the ballast particles partially project from the communication holes of the bag-like object. Then, the ballast particles, which partially project from the communication holes of above or below adjacent bag-like objects, engage with one another, and the bag-like objects are less likely to be displaced in the transverse direction of the track bed. Accordingly, the ballast retaining structure is less likely to be deformed, and thus the track bed is less likely to be deformed.

In this case, the bag-like object may have the plurality of communication holes formed in at least upper and lower surfaces of the bag-like object. With such a configuration, since ballast particles partially projecting from the communication holes of the bag-like objects are increased and thereby the number of mutually engaging ballast particles is increased, the above or below adjacent bag-like objects are less likely to be displaced in the transverse direction of the track bed. Accordingly, the ballast retaining structure is less likely to be deformed, and thus the track bed is less likely to be deformed.

The plurality of communication holes may be unevenly arranged in the upper and lower surfaces of the bag-like object.

Alternatively, the plurality of communication holes may be evenly arranged in the upper and lower surfaces of the bag-like object. Examples of evenly arranging the plurality of communication holes are a case wherein at least upper and lower surfaces of the bag-like object have mesh-like configurations, a case wherein at least upper and lower surfaces of the bag-like object have net-like configurations, and a case wherein at least upper and lower surfaces of the bag-like object have grid-like configurations.

With such a configuration, since ballast particles partially projecting from the communication holes of the bag-like objects are increased and thereby the number of mutually engaging ballast particles is increased, the above or below adjacent bag-like objects are less likely to be displaced in the transverse direction of the track bed. Accordingly, the ballast retaining structure is less likely to be deformed, and thus the track bed is less likely to be deformed.

A further example of evenly arranging the plurality of communication holes is a case wherein at least upper and lower surfaces of the bag-like object are made of nets. With such a configuration, the following operation and effects (1)-(7) can be obtained.

(1) By using a net having a larger mesh size filled with ballast and roller compacting the net with a compactor or the like, friction caused by engagement of ballast particles is increased.

(2) Also, the net filled with ballast has a manually conveyable weight, and requires no large construction equipment, such as heavy equipment, owing to a smaller excavation cross-section than in a case of a conventional ballast retaining structure made of concrete. Accordingly, constructability can be improved, and a greater construction length per night can be achieved.

(3) Further, even if a depression or subsidence of the roadbed occurs due to heavy rain or the like, the net moves in its entirety and therefore a depression of the ballast will not occur. Thus, safe running of trains can be secured.

(4) Since the ballast in the net does not flow out, extra bag-like objects, if placed on the track bed or elsewhere, can be utilized as stockpiled ballast to be, for example, scattered to an area in which ballast has flown out.

(5) Since the ballast in the net does not move, fluidization of ballast occurring in a canted section or the like can be suppressed.

(6) Use of a net or the like leading to a lower material cost and no need of large heavy equipment for construction results in reduced construction costs.

(7) Since the track bed with the bag-like objects can have a greater gradient, a wider maintenance path and a wider shoulder width of the track bed can be secured.

Further, it may be possible to insert a connection member, such as a bar, through mutually opposing communication holes of the bag-like objects constituting the layered body, in order to suppress deformation of the track bed in the transverse direction by means of the ballast retaining structure. Specifically, it may be possible to provide a burial member which includes a bar-like member having a bar shape, the bar-like member being inserted through mutually opposing communication holes among the communication holes of at least two uppermost bag-like objects among the stacked bag-like objects and having an end portion to be buried into the roadbed.

According to this configuration, since the bar-like member inserted through the mutually opposing communication holes among the communication holes of at least two uppermost bag-like objects among the stacked bag-like objects is located inside the layered body, the bar-like member connects the two bag-like objects with each other; and since the leading end of the bar-like member is buried into the roadbed, the bag-like objects mutually connected by the bar-like member are less likely to be displaced in the transverse direction of the track bed. Thus, the ballast retaining structure is further less likely to be deformed by a force acting in the transverse direction of the track bed.

In this case, the bar-like member of the burial member may be inserted through the mutually opposing communication holes among the communication holes of the two bag-like objects in a posture tilted inward the track bed from an upper end portion to a lower end portion of the bar-like member. With such a configuration, a tensile resistance of the reinforcing steel bar when a horizontal force is exerted thereon acts in a direction of suppressing falling of the bag-like objects. Thus, a greater resistance against a horizontal force is achieved.

Moreover, the burial member may include a plurality of the bar-like members and a connection member mutually connecting upper end portions of the plurality of the bar-like members. With such a configuration, when a tensile force is generated in the bar-like members due to a horizontal force, the connection member of the bar-like members acts on the uppermost bag-like object as an overburden stress, and thereby falling movement is suppressed and the uppermost bag-like object is restrained. Also, it is possible to integrate the bag-like objects adjacent with each other, and share the horizontal force in a longitudinal direction. Further, the upper end portions (head portions) of the bar-like members are less likely to project from the bag-like objects, and thus do not obstruct, for example, workers from walking on shoulders of the track bed. In addition, it is possible to drive the plurality of bar-like members at one time, and thus achieve an improved workability.

Next, a tool jig in a second aspect of the present invention is a tool jig which includes: an attachment portion that is capable of being attached to a tool to be used for burying a burial member having a plurality of bar-like members and a connection member which mutually connects upper end portions of the plurality of bar-like members into the ballast retaining structure formed by laying ballast on a roadbed, performing tamping to form a bed-like structure having a predetermined cross-sectional shape such as a trapezoid, and extending the bed-like structure in an extending direction of the roadbed; and a jig main body that is fixed to the attachment portion and has a hole which is capable of at least containing therein a connection member provided to the burial member. By using a tool jig configured as above, it is possible to use a commercially available electric breaker, to thereby drive two reinforcing bars at one time by machine construction. Thus, an improved horizontal bearing capacity can be achieved without deteriorating constructability or workability.

Moreover, a ballast retaining structure in a third aspect of the present invention is a ballast retaining structure used for a bedded track provided with a track bed formed by laying ballast on a roadbed, performing tamping to form a bed-like structure having a predetermined cross-sectional shape such as a trapezoid, and extending the bed-like structure in an extending direction of the roadbed; a plurality of sleepers disposed on the track bed such that longitudinal directions of the sleepers are perpendicular to an extending direction of the track bed; and one or more pairs of rails fastened to upper surfaces of the plurality of sleepers in the extending direction of the track bed. The ballast retaining structure is provided on both sides in the transverse direction of the track bed and in the extending direction of the track bed to thereby retain the track bed from the transverse direction thereof. The ballast retaining structure includes a layered body extended in the extending direction of the roadbed and formed by stacking a plurality of bag-like objects, each being formed in a bag shape and containing the ballast, from a toe of slope to a top of slope of the track bed. The bag-like object has a plurality of communication holes for communicating an inside and an outside thereof formed in at least upper and lower surfaces of the bag-like object. The ballast retaining structure also includes a burial member including a bar-like member having a bar shape, the bar-like member being inserted through mutually opposing communication holes among the communication holes of at least two uppermost bag-like objects among the stacked bag-like objects and having an end portion to be buried into the roadbed. The bar-like member of the burial member is inserted through the mutually opposing communication holes among the communication holes of the two bag-like objects in a posture tilted inward the track bed from an upper end portion to a lower end portion of the bar-like member.

According to the ballast retaining structure configured as above, a layered body extended in the extending direction of the roadbed is provided and the layered body is formed by stacking a plurality of bag-like objects, each being formed in a bag shape and containing the ballast, from a toe of slope to a top of slope of the track bed. The bag-like object described above has a plurality of communication holes for communicating an inside and an outside thereof formed in at least upper and lower surfaces of the bag-like object. The bar-like member of the burial member is inserted through the mutually opposing communication holes among the communication holes of the two bag-like objects in a posture tilted inward the track bed from an upper end portion to a lower end portion of the bar-like member, and the leading end of the bar-like member is buried into the roadbed. Therefore, it is possible to prevent the layered body from sliding or falling when an outward (or external) horizontal force is exerted, and thus is possible to suppress deformation of the track bed of the bedded track even when a large inertial force due to an earthquake motion is exerted on the track bed.

That is, according to the ballast retaining structure of the present invention, resistance (horizontal drag force) possessed by a conventional bedded track against horizontal displacement of the track due to engagement effect of the ballast may be further effectively increased, and deformation of a railway track which is maintained in an accurate manner at a millimeter level may be suppressed. Thus, an effect of improving safety of train running may be achieved.

Moreover, the present invention may be achieved as a bedded track. Specifically, a bedded track in a fourth aspect of the present invention is a bedded track which includes a track bed formed by laying ballast on a roadbed, performing tamping to form a bed-like structure having a predetermined cross-sectional shape such as a trapezoid, and extending the bed-like structure in an extending direction of the roadbed; a plurality of sleepers disposed on the track bed such that longitudinal directions of the sleepers are perpendicular to an extending direction of the track bed; and a pair of rails fastened to upper surfaces of the plurality of sleepers in the extending direction of the track bed. A part of the track bed is constituted by the ballast retaining structure according to the first aspect or the third aspect of the present invention.

EXPLANATION OF REFERENCE NUMERALS

1 . . . roadbed; 2 . . . ballast; 3, 203, 303, 403 . . . track bed; 4 . . . sleeper; 5 . . . rail; 31 . . . layered body; 32 . . . bag-like object; 32*a* . . . communication hole; 33 . . . layered body; 34 . . . bag-like object; 34*a* . . . communication hole; 35 . . . reinforcing steel bar; 35*a*, 35*b* . . . bar-like member; 35*c* . . . connection member; 37 . . . driving jig; 37*a* . . . attachment portion; 37*b* . . . jig main body; 37*c* . . . insertion hole; 100, 200, 300, 400 . . . bedded track; 110, 210, 310, 410 . . . ballast retaining structure

BEST MODE FOR CARRYING OUT THE INVENTION

Hereinafter, embodiments of the present invention will be described with reference to the drawings.

Embodiment

1. Explanation of Configuration of Bedded Track 100

Figure 1A:
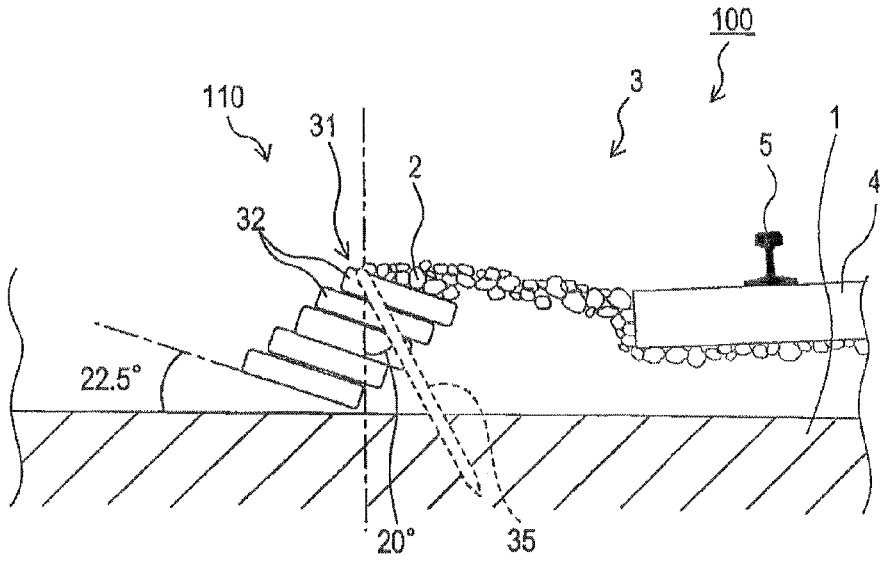
FIG. 1A is a front cross-sectional view showing a configuration of a bedded track in an embodiment.

As shown in FIG. 1A, a bedded track 100 includes a track bed 3, formed by laying ballast 2, such as crushed stones, on a roadbed 1, tamping the ballast 2 so as to form a bed-like structure having a predetermined cross-sectional shape, such as a trapezoid, and extending the bed-like structure in an extending direction of the bedded track 100; a plurality of sleepers 4 (only a part of a sleeper 4 is shown in FIG. 1A) disposed on the track bed 3 such that a longitudinal direction of each sleeper is perpendicular to an extending direction of the track bed 3; and a pair of rails 5 (only one rail 5 is shown in FIG. 1A) fastened to upper surfaces of the plurality of sleepers 4 in the extending direction of the track bed 3.

[Explanation of Configuration of Track Bed 3]

The track bed 3 formed as described above includes a layered body 31, which is disposed from a toe of slope to a top of slope of the track bed 3 and a reinforcing steel bar 35 inserted through the layered body 31.

In the present embodiment, the layered body 31 and the reinforcing steel bar 35 form a ballast retaining structure 110.

Figure 1B:
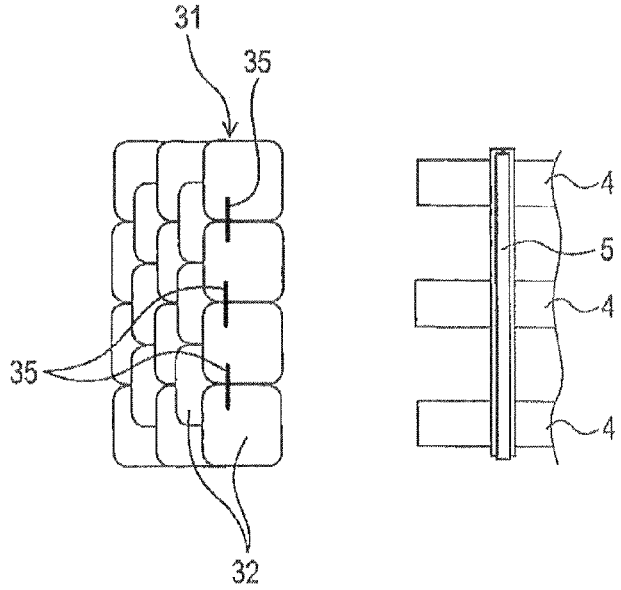
FIG. 1B is a plan view of the bedded track in the embodiment.
Figure 2:
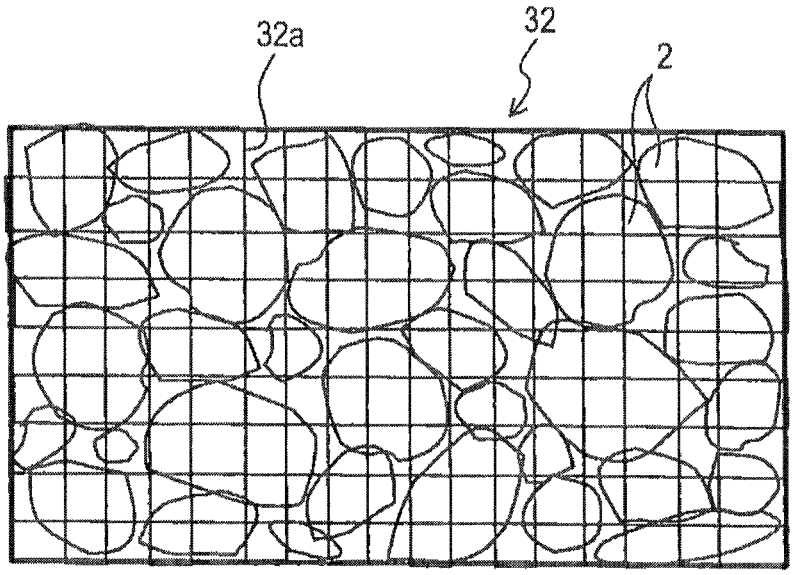
FIG. 2 is an explanatory view showing a configuration of a bag-like object made of net formed in a bag shape.

The layered body 31 has a structure formed by stacking a plurality of bag-like objects 32, each having a bag shape and containing ballast, on the roadbed 1 from the toe of slope to the top of slope of the track bed 3 such that each of the bag-like object 32 is tilted to decline from an outer end portion to an inner end portion thereof, and also extendingly disposing the bag-like objects 32 in the extending direction of the bedded track 100 (the roadbed 1). In the present embodiment, each of the bag-like objects 32 is tilted by 22.5 degrees relative to a horizontal plane so as to decline from the outer end portion to the inner end portion thereof. Also, in the present embodiment, the plurality of bag-like objects 32 constituting the layered body 31 are stacked such that each of the bag-like objects 32 is shifted by 50 mm toward an inside of the track bed 3. Further, in the present embodiment, the plurality of bag-like objects 32 constituting the layered body 31 are stacked such that each of the bag-like objects 32 is shifted by half a width dimension of the bag-like object 32 in the extending direction of the bedded track 100 (the roadbed 1) (see FIG. 1B). The layered body 31 is roller compacted by a compactor. The bag-like object 32 is made of net formed in a bag shape, and thus has a lot of communication holes 32*a* for communicating an inside and an outside of the bag-like object 32 (see FIG. 2). The communication holes 32*a* in the bag-like object 32 are formed to have a size preventing the ballast 2 from passing therethrough. In the present embodiment, a net having a mesh of approximately ½-¼ of an average particle diameter of the ballast 2 is used for forming the bag-like object 32. Accordingly, one of the communication holes 32*a* of the bag-like object 32 constituting the layered body 31 is arranged so as to oppose one of communication holes 32*a* of an above or below adjacent bag-like object 32, and allows insertion therethrough of a later-mentioned reinforcing steel bar 35.

Figure 3:
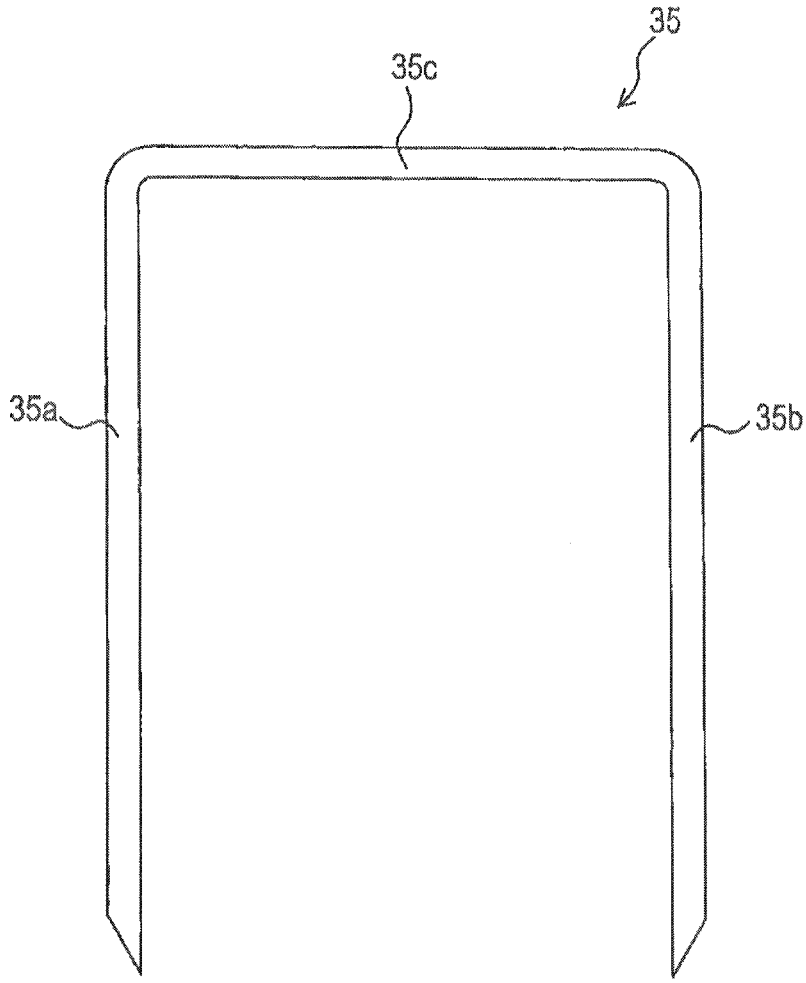
FIG. 3 is a front elevational view showing a configuration of a reinforcing steel bar.

The reinforcing steel bar 35, as shown in FIG. 3, is constituted by a connection member 35*c* made of an iron rod and bar-like members 35*a*, 35*b*, each made of an iron rod projecting from each end of the connection member 35*c* in a same direction (that is, the reinforcing steel bar 35 is formed by bending an iron rod into a U-shape). Hereinafter, a connecting end between each of the bar-like members 35*a*, 35*b* and the connection member 35*c* is referred to as an upper end portion, and an end portion opposite to the upper end portion is referred to as a leading end. The leading end of each of the bar-like members 35*a*, 35*b* is configured to be pointed so as to be easily inserted through the bag-like object 32. In the present embodiment, a deformed steel bar is used as the reinforcing steel bar 35 in order to obtain a greater friction with the ballast 2. The reinforcing steel bar 35 is inserted through the layered body 31 from above downward in a posture tilted from the upper end portions to the lower end portions (the leading ends) at an angle of 15 to 25 degrees (in the present embodiment, 20 degrees which provides a largest horizontal bearing capacity according to a test) inward the track bed 3 relative to a vertical plane. Specifically, the reinforcing steel bar 35 is inserted from the communication hole 32*a* in an upper surface of the layered body 31 to an inside thereof with the leading ends of the two bar-like members 35*a*, 35*b* located at a head, passed through mutually opposing communication holes 32*a* of the bag-like objects 32, and the leading ends are buried into the roadbed 1 under the layered body 31 while a central portion is located inside the layered body 31. In the present embodiment, the reinforcing steel bar 35 is inserted into the bag-like object 32 in an uppermost layer of the layered body 31 from a position of 50 mm inside from an outer end portion of the bag-like object 32 (see FIG. 1B). In this case, the bar-like member 35*a* and the bar-like member 35*b* are inserted into the respective bag-like objects 32, 32 adjacent with each other in the extending direction of the bedded track 100. As a result, the reinforcing steel bar 35 connects with each other the plurality of bag-like objects 32 contacting above or below and constituting the layered body 31, while connecting with each other the plurality of bag-like objects 32 adjacent in the extending direction of the bedded track 100 (roadbed 1).

The reinforcing steel bar 35 corresponds to a burial member. When driving the above-described reinforcing steel bar 35 into the track bed 3 of the bedded track 100, a driving jig 37 as shown in FIG. 5A-FIG. 5F is used.

The driving jig 37 includes, as shown in FIG. 5A-FIG. 5F, an attachment portion 37*a* having a columnar shape to be attached to a commercially available electric breaker, and a jig main body 37*b* which has substantially a rectangular parallelepiped shape and to which a head part (the connection member 35*c* and the upper end portions of the bar-like members 35*a*, 35*b* in the present embodiment) of the reinforcing steel bar 35 to be driven into the track bed 3 of the bedded track 100 can be attached. The jig main body 37*b* includes an insertion hole 37*c* formed for inserting therein the connection member 35*c* and the upper end portions of the bar-like members 35*a*, 35*b* of the reinforcing steel bar 35. The driving jig 37 is used to drive the reinforcing steel bar 35 into the track bed 3 of the bedded track 100 in a state where the attachment portion 37*a* is attached to a pile driving attachment of a commercially available electric breaker, and the connection member 35*c* and the upper end portions of the bar-like members 35*a*, 35*b* of the reinforcing steel bar 35 are inserted in the insertion hole 37*c*.

2. Explanation of Measurement Test

Figure 4:
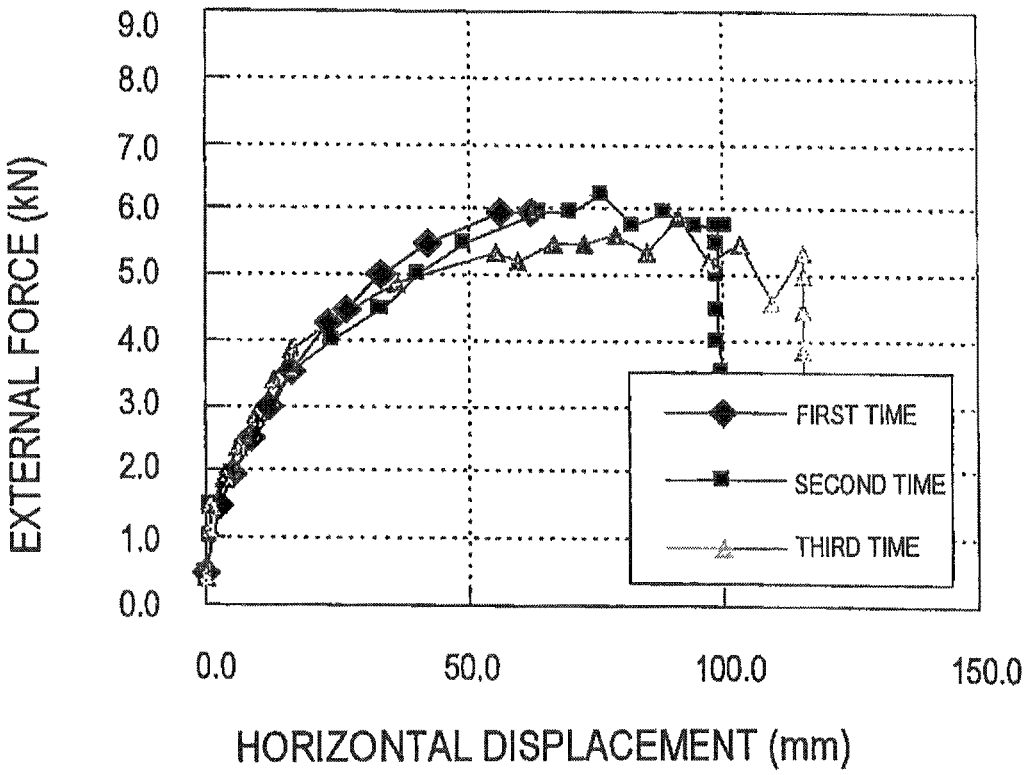
FIG. 4 is an explanatory view showing a relationship between an external force of a ballast retaining structure in the embodiment and a horizontal displacement in an uppermost portion of a layered body formed by stacking bag-like objects.
Figures 5A, 5B, 5C, 5D, 5E, 5F:
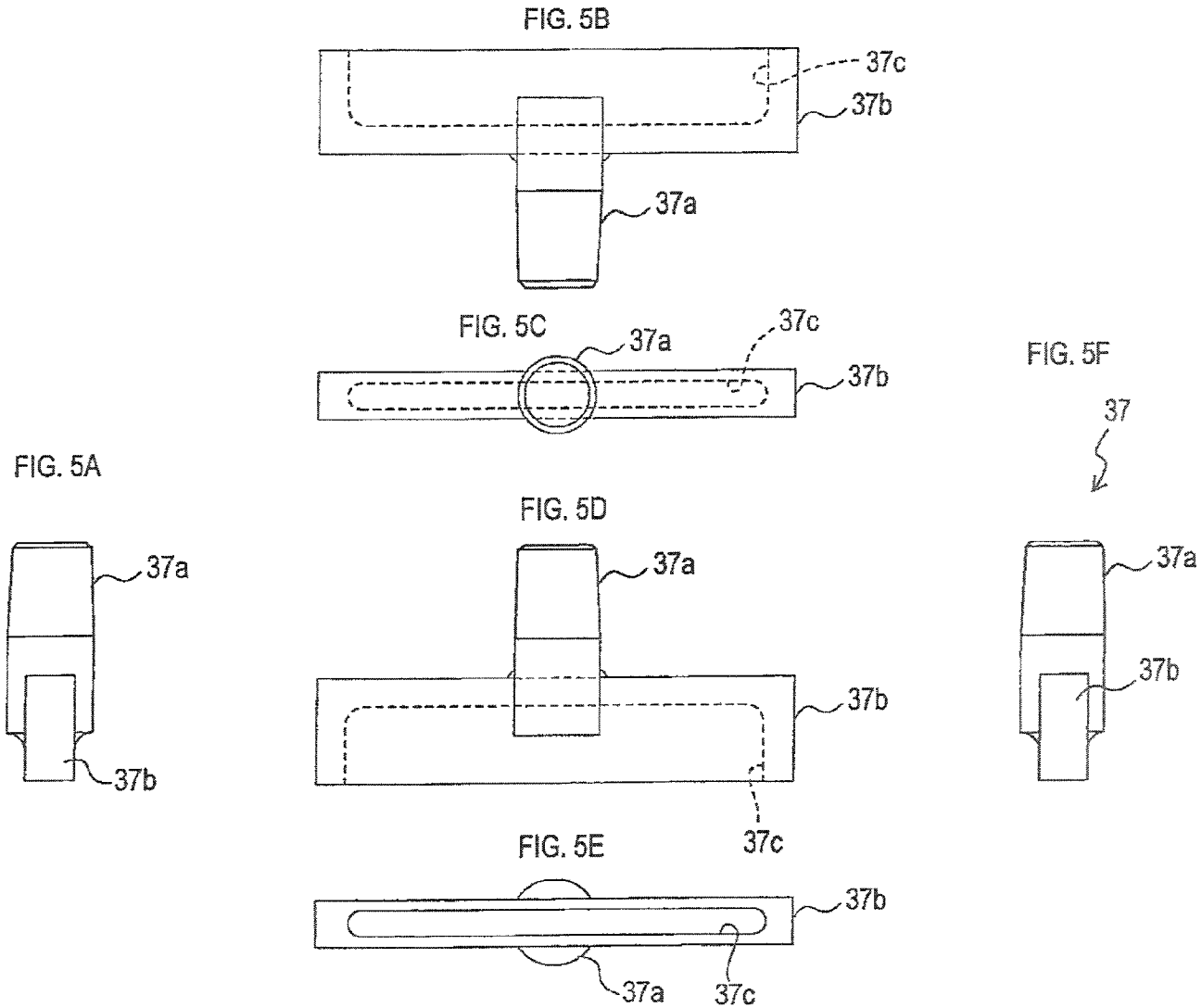
FIG. 5A is a left side elevational view of a driving jig.
FIG. 5B is a rear elevational view of the driving jig.
FIG. 5C is a plan view of the driving jig.
FIG. 5D is a front elevational view of the driving jig.
FIG. 5E is a bottom view of the driving jig.
FIG. 5F is a right side elevational view of the driving jig.

The applicant conducted a test for measuring horizontal displacements (mm) when an external force (kN) is applied to the bedded track 100. Specifically, in the test, horizontal loading is performed on the track bed 3, and when the track bed 3 is deformed to a horizontal displacement of 100 mm, a state of a track is restored to an initial state and then horizontal loading is again performed. The test was repeated three times (see FIG. 4). The test results showed that horizontal displacement against the external force was suppressed to be equal to or smaller than that in a conventional ballast retaining structure of concrete.

3. Effects of Present Embodiment (1) According to the bedded track 100 of the present embodiment, as described above, the layered body 31 has a structure formed by stacking a plurality of bag-like objects 32, each having a bag shape and containing ballast, on the roadbed 1 from the toe of slope to the top of slope of the track bed 3 such that each of the bag-like object 32 is tilted to decline from the outer end portion to the inner end portion thereof, and also extendingly disposing the bag-like objects 32 in the extending direction of the bedded track 100 (the roadbed 1). Accordingly, it is possible to prevent the layered body 31 from sliding or falling when an outward (or external) horizontal force is exerted, and thus is possible to suppress deformation of the track bed 3 of the bedded track 100 even when a large inertial force due to an earthquake motion is exerted on the track bed 3.

That is, according to the bedded track 100 of the present embodiment, resistance (horizontal drag force) possessed by a conventional bedded track against horizontal displacement of the track due to engagement effect of the ballast may be further effectively increased, deformation of a railway track which is maintained in an accurate manner at a millimeter level may be suppressed, and thereby an effect of improving safety of train running may be achieved.

(2) Also, according to the bedded track 100 of the present embodiment, the bag-like objects 32 are stacked such that each of the bag-like objects 32 is shifted by 50 mm toward the inside of the track bed 3. Accordingly, forces of the bag-like objects 32 tilting toward the inside of the track bed 3 become great, and thus resistance against a horizontal force is further increased.

(3) Also, according to the bedded track 100 of the present embodiment, the bag-like objects 32 are stacked such that each of the bag-like objects 32 is shifted by half a width dimension of the bag-like object 32 in the extending direction of the bedded track 100 (the roadbed 1). Accordingly, gaps which are present between rows of the bag-like objects 32 are filled, which increases an entire rigidity and the bag-like objects 32 adjacent with each other in the extending direction of the bedded track 100 (the roadbed 1) are mutually engaged firmly to be integrated. Thus, resistance against a horizontal force is further increased.

(4) Further, according to the bedded track 100 of the present embodiment, a net having a mesh of approximately ½-¼ of an average particle diameter of the ballast 2 is used for forming the bag-like object 32, and a lot of communication holes 32*a* for communicating the inside and the outside of the bag-like object 32 are formed. As a result, particles of the ballast 2 partially projecting from the communication holes 32*a* of the bag-like objects 32 are increased, and the number of mutually engaging particles of the ballast 2 is increased. Then, the above or below adjacent bag-like objects 32 are further less likely to be displaced in a transverse direction of the track bed 3, and thereby the ballast retaining structure 110 is less likely to be deformed, and thus the track bed 3 is less likely to be deformed.

(5) Moreover, according to the bedded track 100 of the present embodiment, the bag-like object 32 is made of a net having a mesh of approximately ½-¼ of an average particle diameter of the ballast 2. This leads to the following operation and effects.

(5-1) By using the bag-like object 32 of net containing the ballast 2 and roller compacting the bag-like object 32 by a compactor or the like, friction by engagement of ballast particles is increased.

(5-2) Also, the bag-like object 32 of net, even containing the ballast 2, has a weight such that the bag-like object 32 can be manually conveyed, and no large construction equipment, such as heavy equipment, is needed since an excavation cross-section is small. Accordingly, constructability can be improved, and a greater construction length per night can be achieved.

(5-3) Further, even if a depression or subsidence of the roadbed 1 occurs due to heavy rain or the like, the bag-like object 32 of net moves in its entirety and therefore a depression of the ballast 2 will not occur. Thus, safe running of trains can be secured.

(5-4) Since the ballast 2 in the bag-like object 32 of net does not flow out, extra bag-like objects 32, if placed on the track bed 3 or elsewhere, can be utilized as stockpiled ballast to be, for example, scattered to an area in which ballast has flown out.

(5-5) Since the ballast 2 in the bag-like object 32 of net does not move, fluidization of the ballast 2 occurring in a canted section or the like can be suppressed.

(5-6) Use of the bag-like objects 32 of net leads to a lower material cost, and no need of large heavy equipment for construction leads to a reduced construction cost.

(5-7) Since the track bed 3 may have a greater gradient by using the bag-like objects 32 of net, a wider maintenance path may be secured.

(6) Also, according to the bedded track 100 of the present embodiment, the reinforcing steel bar 35 in the ballast retaining structure 110 is formed by bending an iron rod into a U-shape. Specifically, the reinforcing steel bar 35 is constituted by two bar-like members 35*a*, 35*b* having a bar shape and a connection member 35*c* connecting the upper ends of bar-like members 35*a*, 35*b* with each other, and the reinforcing steel bar 35 is inserted through the layered body 31 from above downward in a posture tilted from the upper end portions to the lower end portions at an angle of 15 to 25 degrees (in the present embodiment, 20 degrees which provides a largest horizontal bearing capacity according to the test) inward the track bed 3 relative to a vertical plane.

Accordingly, the bag-like objects 32 connected with each other by the reinforcing steel bar 35 are less likely to be displaced in the transverse direction of the track bed 3, and thereby the ballast retaining structure 110 is further less likely to be deformed by a force acting in the transverse direction of the track bed 3.

(6-1) The reinforcing steel bar 35 is inserted through the layered body 31 from above downward in a posture tilted from the upper end portions to the lower end portions at an angle of 15 to 25 degrees (in the present embodiment, 20 degrees which provides a largest horizontal bearing capacity according to the test) inward the track bed 3 relative to a vertical plane. Accordingly, a tensile resistance of the reinforcing steel bar 35 when a horizontal force is exerted thereon acts in a direction of suppressing falling of the bag-like objects 32. Also, when a tensile force is generated in the reinforcing steel bar 35 due to a horizontal force, a connecting portion (the connection member 35*c*) of the reinforcing steel bar 35 acts on the uppermost bag-like objects 32 as an overburden stress. In this case, as compared with a case of stacking the bag-like objects 32 in a horizontal state without tilting and inserting the reinforcing steel bar 35 therein in the vertical direction, one and a half times the horizontal bearing capacity is obtained. Thus, a greater resistance against the horizontal force is achieved.

(6-2) The bar-like member 35*a* and the bar-like member 35*b* of the reinforcing steel bar 35 are inserted into the respective bag-like objects 32, 32 adjacent with each other, and the reinforcing steel bar 35 connects with each other the plurality of bag-like objects 32 contacting above or below and constituting the layered body 31, while connecting with each other the plurality of bag-like objects 32 adjacent in the extending direction of the bedded track 100 (roadbed 1). Thus, it is possible to integrate the bag-like objects 32 adjacent with each other, and the connected bag-like objects 32 adjacent with each other in the extending direction of the bedded track 100 (roadbed 1) can resist a horizontal force in a shared manner.

(6-3) Since the reinforcing steel bar 35 is constituted by the two bar-like members 35*a*, 35*b* having a bar shape and the connection member 35*c* connecting the upper ends of the bar-like members 35*a*, 35*b* (that is, formed by bending an iron rod into a U-shape), the upper ends of the bar-like members 35*a*, 35*b* (head portions) do not project from the bag-like objects 32. Also, it is possible to drive the plurality of bar-like members 35*a*, 35*b* at one time, to thereby achieve an improved workability. In addition, it is possible to reduce dynamic displacement of the uppermost bag-like objects 32 due to an earthquake motion.

(7) Also, according to the bedded track 100 of the present embodiment, by using the driving jig 37 including the attachment portion 37*a* to be attached to a commercially available electric breaker, and the jig main body 37*b* to which a head part (the connection member 35*c* and the upper end portions of the bar-like members 35*a*, 35*b* in the present embodiment) of the reinforcing steel bar 35 to be driven into the track bed 3 of the bedded track 100 can be attached, it is possible to use a commercially available electric breaker, drive two reinforcing bars at one time by machine construction. Thus, an improved horizontal bearing capacity can be achieved without deteriorating constructability or workability.

4. Other Embodiments

Although an embodiment of the present invention has been described as above, the present invention should not be limited to the above-described embodiment but may be practiced in various forms as below (1) In the above described embodiment, the bag-like object 32 of the layered body 31 is made of net formed in a bag shape and thereby has a lot of communication holes 32*a* for communicating the inside and the outside of the bag-like object 32. However, the present invention is not limited to this configuration, but may be configured such that communication holes 32*a* for communicating the inside and the outside of the bag-like object 32 are provided at least in upper and lower surfaces of the bag-like object 32. Such a configuration may also achieve the same operation and effects as the above described embodiment.

(2) Also, while the bag-like object 32 of the layered body 31 is made of net formed in a bag shape and thereby has a lot of communication holes 32*a* for communicating the inside and the outside of the bag-like object 32 in the above described embodiment, as mentioned above, the present invention is not limited to this configuration, but may be any other configuration, such as a grid or mesh, as long as a lot of holes for communicating the both surfaces are provided. Such a configuration may also achieve the same operation and effects as the above described embodiment.

(3) Further, the bag-like object 32 of the layered body 31 is made of net formed in a bag shape and thereby has a lot of communication holes 32*a* for communicating the inside and the outside of the bag-like object 32 as mentioned above, that is, the plurality of communication holes 32*a* are evenly arranged in the bag-like object 32 in the above described embodiment. However, the present invention is not limited to this configuration, but may be configured such that the plurality of communication holes 32*a* are unevenly arranged in the bag-like object 32 as long as each of the communication holes 32*a* is arranged so as to oppose any one of the communication holes 32*a* in above or below adjacent bag-like objects 32 and allow insertion of the steel reinforcing bar 35 therethrough. Such a configuration may also achieve the same operation and effects as the above described embodiment.

(4) The above described embodiment takes an example in which the present invention is applied to the bedded track 100 provided with a pair of rails 5. However, the present invention is not limited to this, but may be applied to a bedded track provided with a plurality of pairs of rails.

(5) In the above described embodiment, the layered body 31 is formed by stacking the plurality of bag-like objects 32, each having a bag shape and containing ballast, on the roadbed 1 from the toe of slope to the top of slope of the track bed 3 such that each of the bag-like object 32 is tilted to decline from an outer end portion to an inner end portion thereof. However, the present invention is not limited to this configuration, but may be configured such that the layered body 31 is formed by stacking a plurality of bag-like objects 32, each having a bag shape and containing ballast, on the roadbed 1 from the toe of slope to the top of slope of the track bed 3 in a horizontal state without tilting and inserting the reinforcing steel bar 35 through the layered body 31 from above downward in a posture tilted from the upper end portions to the lower end portions at an angle of 15 to 25 degrees (in the present embodiment, 20 degrees which provides a largest horizontal bearing capacity according to the test) inward the track bed 3 relative to a vertical plane.

Also according to such a configuration, a tensile resistance of the reinforcing steel bar 35 when a horizontal force is exerted thereon acts in a direction of suppressing falling of the bag-like objects 32. Also, when a tensile force is generated in the reinforcing steel bar 35 due to a horizontal force, a connecting portion (the connection member 35*c*) of the reinforcing steel bar 35 acts on the uppermost bag-like objects 32 as an overburden stress. As a result, it is possible to prevent the layered body 31 from sliding or falling when an outward (or external) horizontal force is exerted, and thus is possible to suppress deformation of the track bed 3 of the bedded track 100 even when a large inertial force due to an earthquake motion is exerted on the track bed 3. That is, resistance (horizontal drag force) possessed by a conventional bedded track against horizontal displacement of the track due to engagement effect of the ballast may be further effectively increased, deformation of a railway track which is maintained in an accurate manner at a millimeter level may be suppressed, and thus an effect of improving safety of train running may be achieved.

Figure 6A:
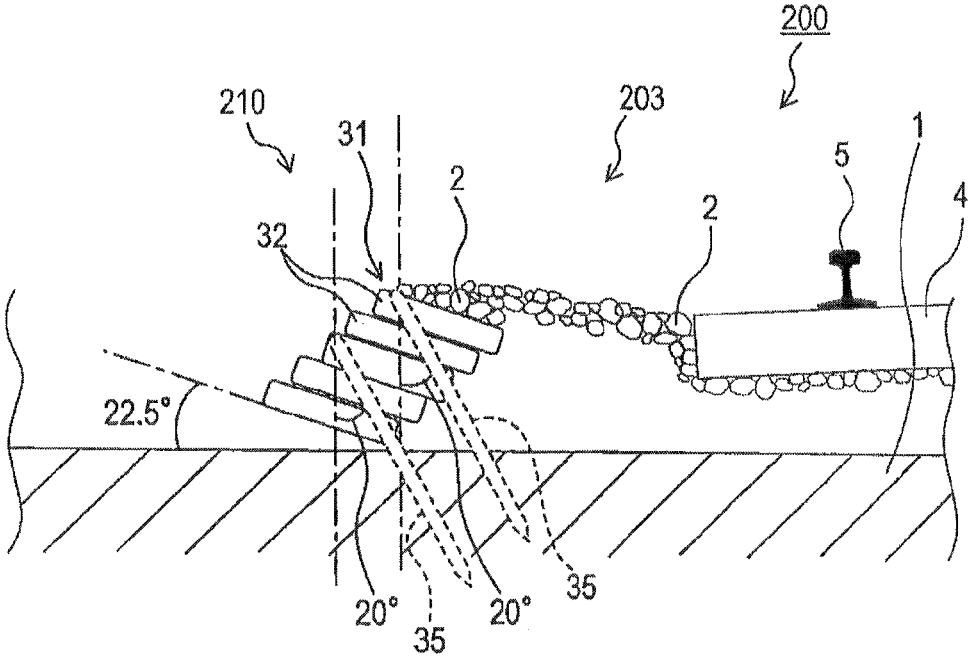
FIG. 6A is a front cross-sectional view showing a configuration of a bedded track in another embodiment.
Figure 6B:
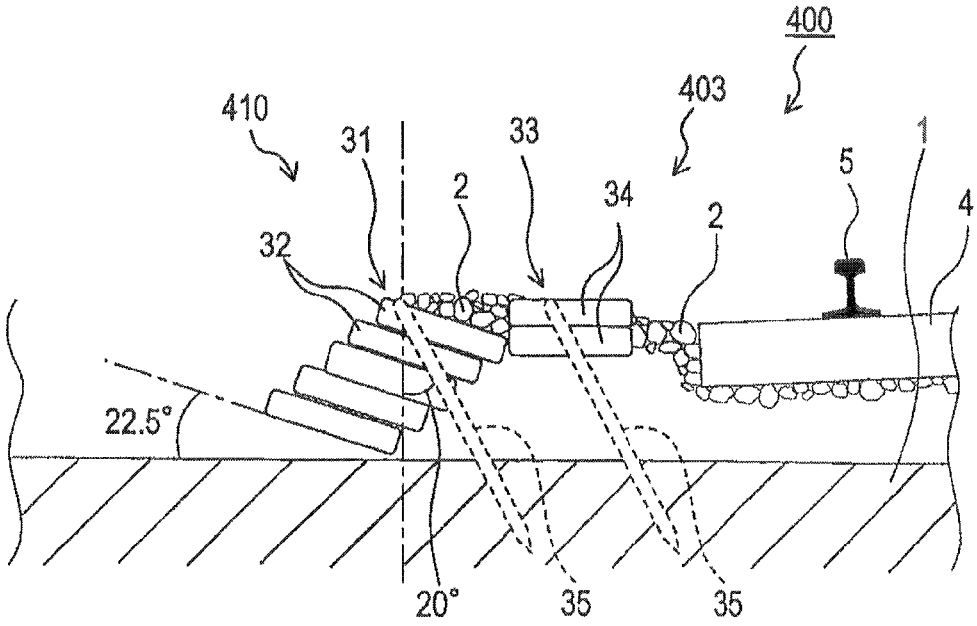
FIG. 6B is a front cross-sectional view showing a configuration of a bedded track in a further embodiment.

(6) According to the bedded track 100 of the above described embodiment, the reinforcing steel bar 35 is inserted through the layered body 31 from above downward in a posture tilted from the upper end portions to the lower end portions (the leading ends) at an angle of 15 to 25 degrees (in the present embodiment, 20 degrees which provides a largest horizontal bearing capacity according to the test) inward the track bed 3 relative to a vertical plane, and the reinforcing steel bar 35 is inserted into the bag-like object 32 in the uppermost layer of the layered body 31 from the position of 50 mm inside from the outer end portion of the bag-like object 32. However, the present invention is not limited to this configuration, but may be configured such that an additional reinforcing steel bar 35 is inserted into the bag-like object 32 in a second uppermost or subsequent layer of the layered body 31 from a position of 50 mm inside from an outer end portion of the bag-like object 32. That is, a plurality of the reinforcing steel bars 35 may be inserted through the layered body 31 from above downward in a posture tilted from the upper end portions to the lower end portions (the leading ends) at an angle of 15 to 25 degrees (in the present embodiment, 20 degrees which provides a largest horizontal bearing capacity according to the test). FIG. 6A, shows an example in which the reinforcing steel bar 35 is inserted from the position of 50 mm inside from the outer end portion of the bag-like object 32 in the uppermost layer of the layered body 31 and the reinforcing steel bar 35 is also inserted from the position of 50 mm inside from the outer end portion of the bag-like object 32 in the third uppermost layer of the layered body 31.

According to the reinforcing steel bars configured as such, it is possible to further effectively suppress deformation of the track bed 203 of the bedded track 200 even in a case where a large inertial force is exerted on the track bed 203 by an earthquake motion.

Figure 7A:
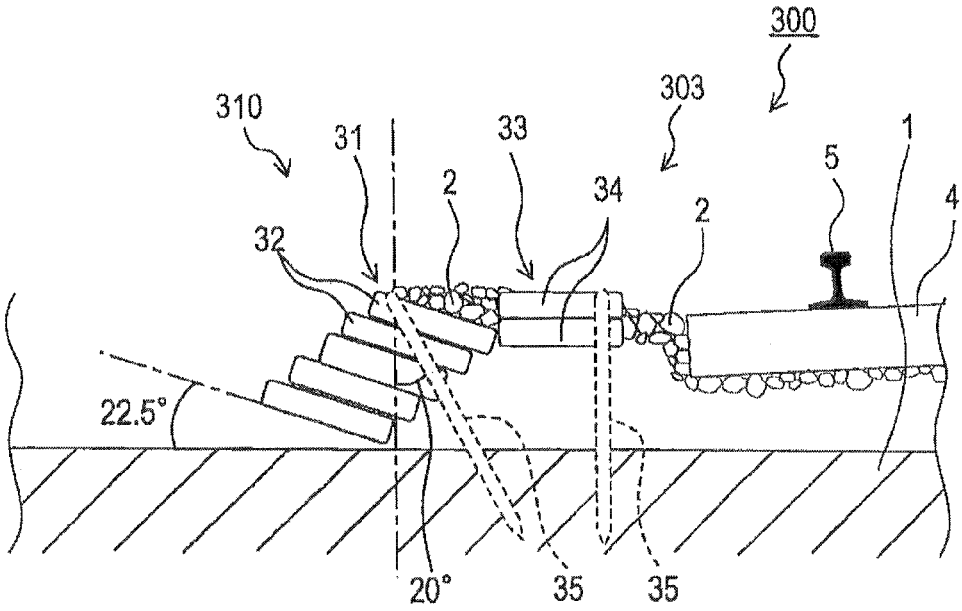
FIG. 7A is a front cross-sectional view showing a configuration of a bedded track in yet another embodiment.

(7) In the bedded track 100 of the above described embodiment, the track bed 3 includes the layered body 31. However, the present invention is not limited to this configuration, but may be configured such that a track bed 303 includes the layered body 31 and a layered body 33 disposed between the layered body 31 and the sleepers 4, as a bedded track 300 exemplified in FIG. 7A.

The layered body 33 is configured such that a plurality of bag-like objects 34, each being made of net formed in a bag shape and containing the ballast 2, are stacked in an up and down direction between the layered body 31 of the track bed 3 and the sleepers 4, and are also extendingly disposed in an extending direction of the bedded track 200 (the roadbed 1), each of the bag-like objects 34 is shifted by half a width dimension of the bag-like object 34 in the extending direction of the bedded track 300 (the roadbed 1). The layered body 33 is disposed on the ballast 2 laid on the roadbed 1. Also, the layered body 33 is roller compacted by a compactor. The layered body 33 is disposed so as to contact the layered body 31, and the ballast 2 is laid between the layered body 33 and the sleepers 4. The bag-like object 34 is made of net formed in a bag shape, as described above, and thereby has a lot of communication holes (figure is omitted) for communicating an inside and an outside of the bag-like object 34, in a same manner as the bag-like object 32. The communication holes in the bag-like object 34 are formed to have a size preventing the ballast 2 from passing therethrough. In the present embodiment, a net having a mesh of approximately ½-¼ of an average particle diameter of the ballast 2 is used for forming the bag-like object 34. Accordingly, one of the communication holes of the bag-like object 34 constituting the layered body 33 is arranged so as to oppose one of communication holes of an above or below adjacent bag-like object 34, and allows insertion therethrough of the reinforcing steel bar 35.

The reinforcing steel bar 35 is inserted through the layered body 33 from above downward in a posture perpendicular to the roadbed 1. Specifically, the reinforcing steel bar 35 is inserted from a communication hole in an upper surface of the layered body 33 to an inside with leading ends of the two bar-like members 35*a*, 35*b* located at the head, and is passed through mutually opposing communication holes of the bag-like objects 34. The leading ends are buried into the roadbed 1 under the layered body 33 while central portions are located inside the layered body 33.

Figure 7B:
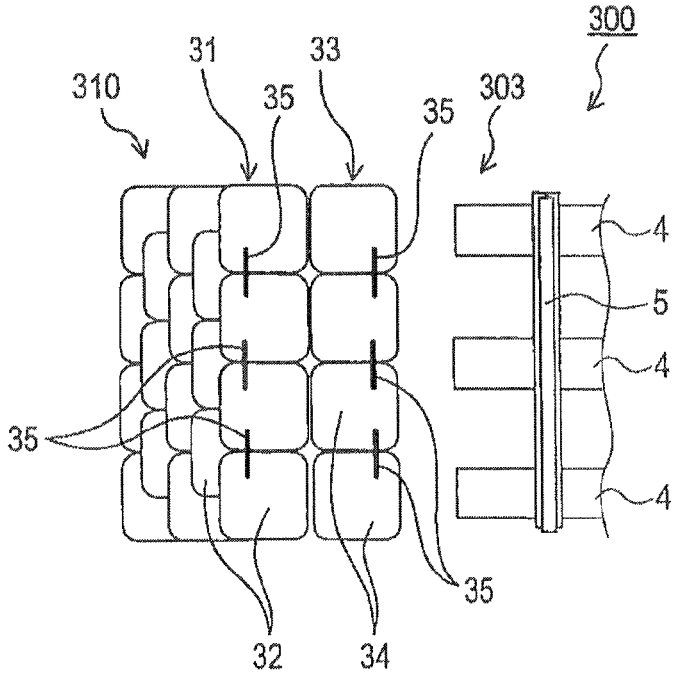
FIG. 7B is a plan view of FIG. 7A.
Figure 8A:
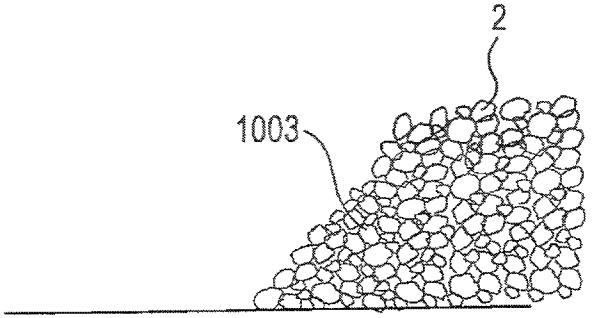
FIG. 8A is a cross-sectional view showing a configuration of ballast (a ballast cross-section)
Figure 8B:
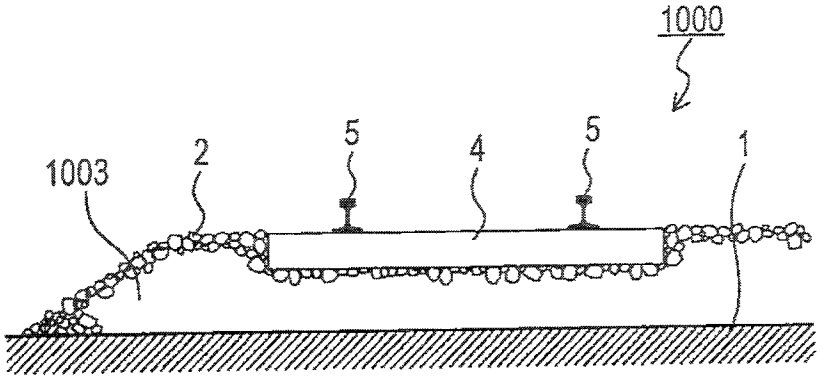
FIG. 8B is a cross-sectional view showing configuration of a conventional bedded track.
Figure 8C:
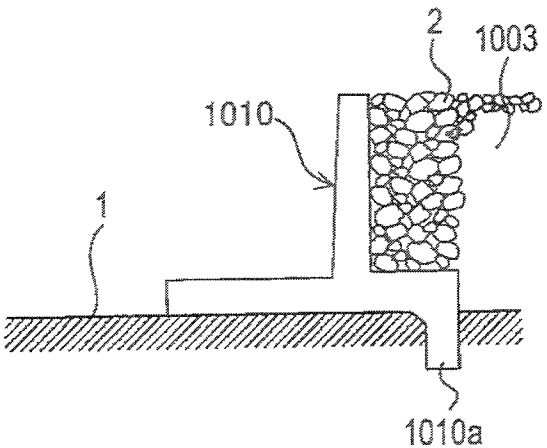
FIG. 8C is a cross-sectional view showing a configuration of a conventional ballast retaining structure.
Figure 8D:
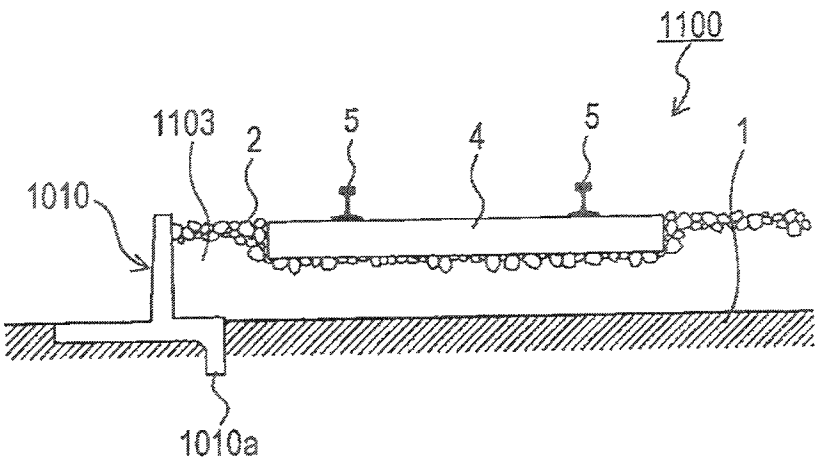
FIG. 8D is a cross-sectional view showing a configuration of a bedded track including the conventional ballast retaining structure.

In the present embodiment, the reinforcing steel bar 35 is inserted into the bag-like object 34 in an uppermost layer of the layered body 33 from a position of 50 mm inside from an outer end portion of the bag-like object 34(see FIG. 7B). In this case, the bar-like member 35*a* and the bar-like member 35*b* are inserted into the respective bag-like objects 34, 34 adjacent with each other. Consequently, the reinforcing steel bar 35 connects with each other the plurality of bag-like objects 34 contacting above or below and constituting the layered body 33, while connecting with each other the plurality of bag-like objects 34 adjacent in the extending direction of the bedded track 300 (the roadbed 1).

In this case, the layered body 31, the layered body 33 and the reinforcing steel bar 35 constitute a ballast retaining structure 310.

The ballast retaining structure 310 as such may also achieve the same operation and effects as the above described embodiment.

(8) In the bedded track 300 of the above described another embodiment, the reinforcing steel bar 35 is inserted through the layered body 33 from above downward in the posture perpendicular to the roadbed 1 (see FIG. 7). However, the present invention is not limited to this configuration, but may be configured such that the reinforcing steel bar 35 is inserted through the layered body 33 from above downward in a posture tilted from the upper end portions to the lower end portions at an angle of 15 to 25 degrees (in the present embodiment, 20 degrees which provides a largest horizontal bearing capacity according to the test) inward a track bed 403 relative to a vertical plane. In this case, the layered body 31, the layered body 33 and the reinforcing steel bar 35 constitute a ballast retaining structure 410.

Such a configuration may also achieve the same operation and effects as the above described embodiment.

What is claimed is:

1. A ballast retaining structure used for a bedded track provided with a track bed formed by laying ballast on a roadbed, performing tamping to form a bed-like structure having a predetermined cross-sectional shape such as a trapezoid, and extending the bed-like structure in an extending direction of the roadbed; a plurality of sleepers disposed on the track bed such that longitudinal directions of the sleepers are perpendicular to an extending direction of the track bed; and one or more pairs of rails fastened to upper surfaces of the plurality of sleepers in the extending direction of the track bed, the ballast retaining structure being provided on both sides in a transverse direction of the track bed and in the extending direction of the track bed to thereby retain the track bed from the transverse direction thereof, the ballast retaining structure comprising:

a layered body extended in the extending direction of the roadbed and formed by stacking a plurality of bag-like objects, each being formed in a bag shape and containing the ballast and a plurality of communication holes for communicating an inside and an outside thereof formed in at least upper and lower surfaces of the bag-like object, from a toe of slope to a top of slope of the track bed such that each of the bag-like objects is tilted to decline from an outer end portion to an inner end portion thereof; and a burial member including a bar-like member having a bar shape, the bar-like member being inserted through mutually opposing communication holes among the communication holes of at least two uppermost bag-like objects among the stacked bag-like objects and having an end portion to be buried into the roadbed.

2. The ballast retaining structure according to claim 1, wherein the layered body is formed by stacking the plurality of bag-like objects, while shifting each of the plurality of bag-like objects toward an inside of the track bed.

3. The ballast retaining structure according to claim 1, wherein the layered body is formed by stacking the plurality of bag-like objects, while shifting each of the plurality of bag-like objects in an extending direction of the roadbed.

4. The ballast retaining structure according to claim 1, wherein the at least upper and lower surfaces of the bag-like object have net-like configurations, so that the bag-like object has the plurality of communication holes for communicating the inside and the outside thereof formed in the at least upper and lower surfaces.

5. The ballast retaining structure according to claim 1, wherein the at least upper and lower surfaces of the bag-like object are constituted by nets, so that the bag-like object has the plurality of communication holes for communicating the inside and the outside thereof formed in the at least upper and lower surfaces.

6. The ballast retaining structure according to claim 1, wherein the bar-like member of the burial member is inserted through the mutually opposing communication holes among the communication holes of the two bag-like objects in a posture tilted inward the track bed from an upper end portion to a lower end portion of the bar-like member.

7. The ballast retaining structure according to claim 1, wherein the burial member includes a plurality of the bar-like members and also includes a connection member mutually connecting upper end portions of the plurality of the bar-like members.

8. A ballast retaining structure used for a bedded track provided with a track bed formed by laying ballast on a roadbed, performing tamping to form a bed-like structure having a predetermined cross-sectional shape such as a trapezoid, and extending the bed-like structure in an extending direction of the roadbed; a plurality of sleepers disposed on the track bed such that longitudinal directions of the sleepers are perpendicular to an extending direction of the track bed; and one or more pairs of rails fastened to upper surfaces of the plurality of sleepers in the extending direction of the track bed, the ballast retaining structure being provided on both sides in a transverse direction of the track bed and in the extending direction of the track bed to thereby retain the track bed from the transverse direction thereof, the ballast retaining structure comprising:

a layered body extended in the extending direction of the roadbed and formed by stacking a plurality of bag-like objects, each being formed in a bag shape and containing the ballast, from a toe of slope to a top of slope of the track bed, the bag-like object having a plurality of communication holes for communicating an inside and an outside thereof formed in at least upper and lower surfaces of the bag-like object; and a burial member including a bar-like member having a bar shape, the bar-like member being inserted through mutually opposing communication holes among the communication holes of at least two uppermost bag-like objects among the stacked bag-like objects and having an end portion to be buried into the roadbed, the bar-like member of the burial member being inserted through the mutually opposing communication holes among the communication holes of the two bag-like objects in a posture tilted inward the track bed from an upper end portion to a lower end portion of the bar-like member;

wherein the burial member includes a plurality of the bar-like members and a connection member mutually connecting the upper end portions of the plurality of the bar-like members.

9. The ballast retaining structure according to claim 8, wherein the at least upper and lower surfaces of the bag-like object have net-like configurations, so that the bag-like object has the plurality of communication holes for communicating the inside and the outside thereof formed in the at least upper and lower surfaces.

10. The ballast retaining structure according to claim 8, wherein the at least upper and lower surfaces of the bag-like object are constituted by nets, so that the bag-like object has the plurality of communication holes for communicating the inside and the outside thereof formed in the at least upper and lower surfaces.

11. A bedded track comprising:

a track bed formed by laying ballast on a roadbed, performing tamping to form a bed-like structure having a predetermined cross-sectional shape such as a trapezoid, and extending the bed-like structure in an extending direction of the roadbed;

a plurality of sleepers disposed on the track bed such that longitudinal directions of the sleepers are perpendicular to an extending direction of the track bed; and one or more pairs of rails fastened to upper surfaces of the plurality of sleepers in the extending direction of the track bed, wherein at least part of the track bed is constituted by a ballast retaining structure being provided on both sides in a transverse direction of the track bed and in an extending direction of the track bed to thereby retain the track bed from the transverse direction thereof; and wherein the ballast retaining structure comprises a layered body extended in the extending direction of the roadbed and formed by stacking a plurality of bag-like objects, each being formed in a bag shape and containing the ballast, from a toe of slope to a top of slope of the track bed such that each of the bag-like objects is tilted to decline from an outer end portion to an inner end portion thereof.

* * * * *